United States Patent [19]

Gutter

[11] 4,352,531

[45] Oct. 5, 1982

[54] COMMONING ELEMENT FOR AN ELECTRICAL CONNECTOR

[75] Inventor: David H. Gutter, Harrisburg, Pa.

[73] Assignee: AMP Incorporated, Harrisburg, Pa.

[21] Appl. No.: 155,905

[22] Filed: Jun. 2, 1980

[51] Int. Cl.[3] ..... H01R 9/07; H01R 23/06

[52] U.S. Cl. ..... 339/14 R; 339/19; 339/107; 339/176 MF

[58] Field of Search ..... 339/14 R, 14 L, 17 F, 339/19, 176 MF, 198 R, 198 P, 198 S, 198 N, 143 R, 107

[56] References Cited

U.S. PATENT DOCUMENTS

| | | | |
|---|---|---|---|
| Re. 27,429 | 7/1972 | Gilissen | 339/198 |
| 3,437,983 | 4/1969 | Gilissen | 339/198 |
| 3,835,442 | 9/1974 | Anderson et al. | 339/198 R |
| 4,084,872 | 4/1978 | Pritulsky | 339/19 |
| 4,142,768 | 3/1979 | Pittman et al. | 339/19 |
| 4,179,171 | 12/1979 | Shannon | 339/17 LC |
| 4,232,929 | 11/1980 | Zobawa | 339/143 R |

FOREIGN PATENT DOCUMENTS

| | | | |
|---|---|---|---|
| 221872 | 9/1924 | United Kingdom | 339/198 S |

*Primary Examiner*—Neil Abrams
*Attorney, Agent, or Firm*—Adrian J. LaRue

[57] ABSTRACT

A commoning element for electrically interconnecting a row of electrical contacts within a connector housing block is disclosed. A plurality of contact members are seated within a row of housing block cavities which are accessible from an upper surface of the housing block. The commoning element, comprising an elongate helical spring, is axially positioned across the row of cavities and subsequently compressed downwardly by a cover plate, whereupon commoning electrical engagement between coils of the helical spring and the contact members is established.

7 Claims, 6 Drawing Figures

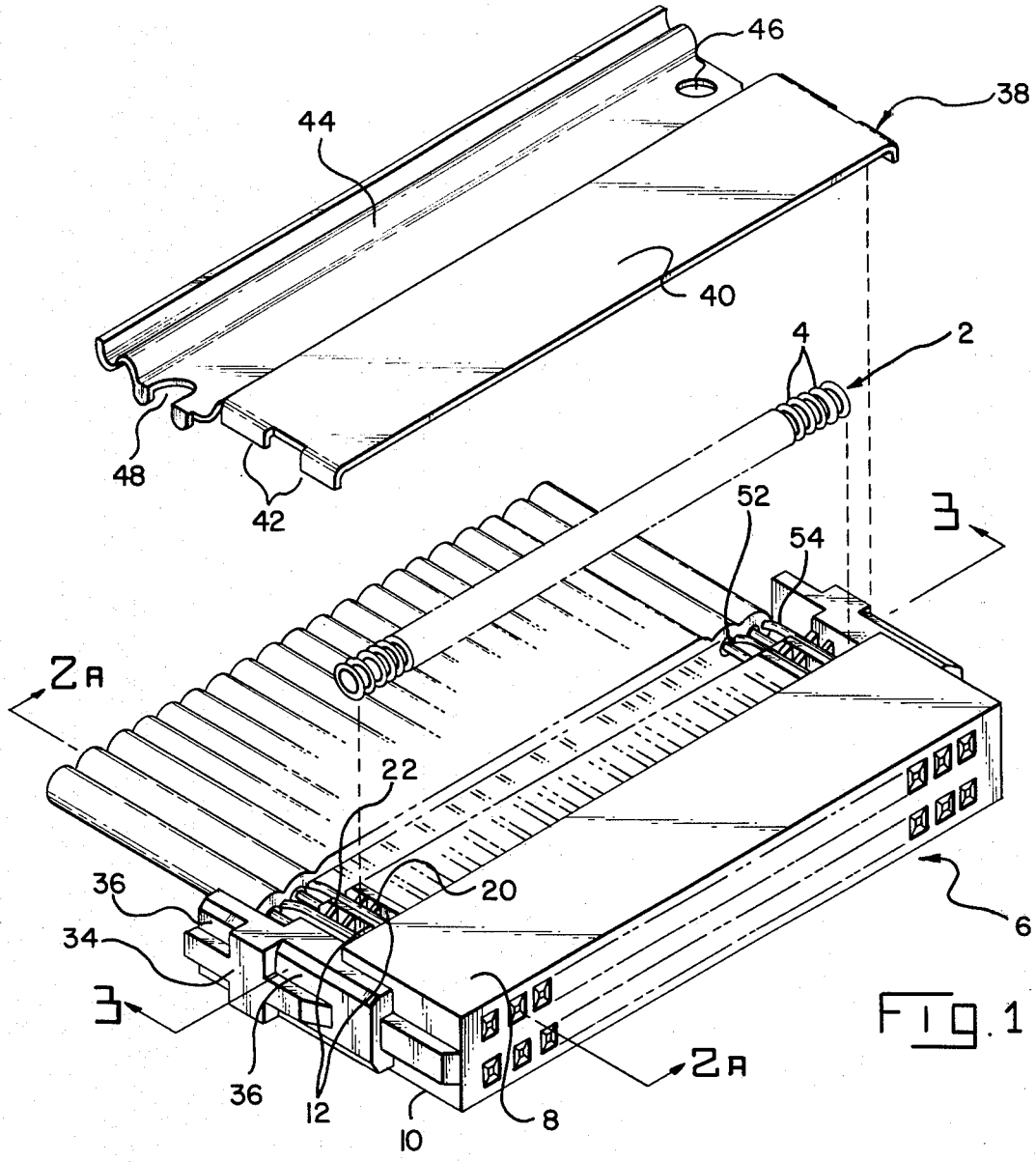
Fig. 1
Fig. 2A
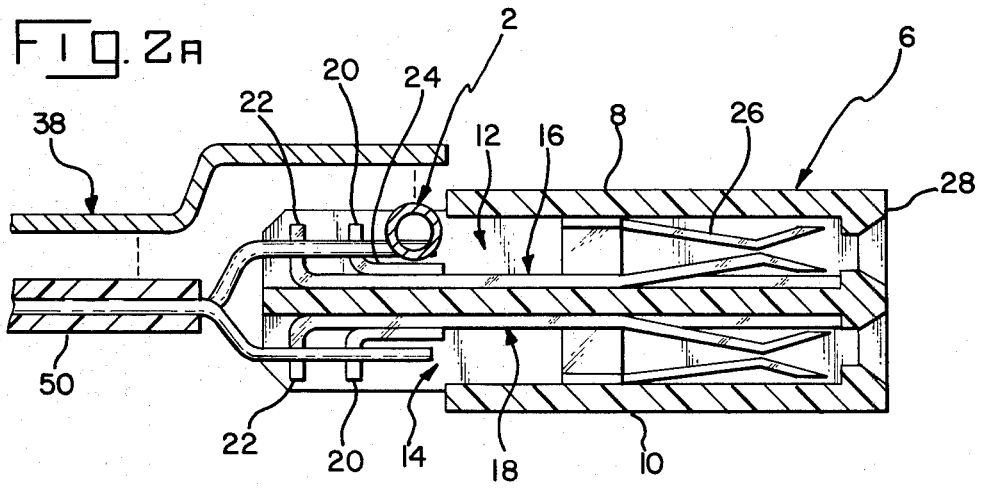

COMMONING ELEMENT FOR AN ELECTRICAL CONNECTOR

BACKGROUND OF THE INVENTION

1. The Field of the Invention

The present invention relates generally to commoning bars for electrically interconnecting a row of electrical contacts within a connector housing block. Generally, the present invention relates to connectors intended for the termination of flat transmission cables.

2. The Prior Art

Many connectors are commercially available for terminating flat transmission cable. In practice, many of these connectors are of the two sided variety, with the ground conductors of the transmission cable intended to be directed to one side of the connector housing and terminated to contacts therein, and the signal conductors of the transmission cable directed to the opposite side of the connector housing and terminated to terminals located therein. For such connectors, means for commoning the row of contacts which terminate the ground conductors in one side of the connector housing, are employed and typically comprise a grounding buss bar which is inserted transversely into the connector housing side to engage the ground conductors.

While the above commoning ground buss arrangement works well, in practical application, the bars are generally difficult to manufacture, and are difficult to assemble within the connector housing. Accordingly, the industry has been in need of a grounding arrangement for two sided connectors, which could conveniently be assembled to the connector housing, and which could provide positive and effective interconnection of a row of electrical contacts seated within the connector housing block. A commoning element satisfying the industry's needs, must be inexpensive to manufacture, and readily incorporated into the connector housing unit. Achievement of a suitable grounding configuration has been difficult because the connector is very densely loaded with contact terminals which terminate small guage transmission cable conductors. Resultingly, the commoning confuguration used for such a connector must be of a relatively miniature scale, which places considerable design constraints on the achievement of a commoning element which will satisfy performance requirements, yet be easily assembled to the connector unit.

SUMMARY OF THE PRESENT INVENTION

The present invention resides in a commoning element for electrically interconnecting a row of electrical contacts within a connector housing block. In a connector of the type incorporating a plurality of contact members which are seated within a row of contact receiving cavities, the present invention contemplates the utilization of an elongate helical spring, which is axially positioned across the row of cavities, and subsequently compressed downwardly therein by a cover plate, whereupon commoning electrical engagement between the spring coils and the contact members is established.

Accordingly, it is an object of the present invention to provide a commoning component for electrically interconnecting a row of electrical contacts within a connector housing block.

A further object of the present invention is to provide a connector commoning component for electrically interconnecting a row of electrical contacts within one side of a two sided connector housing block.

Still further, it is an object of the present invention to provide a commoning component for electrically interconnecting a row of cable conductors which are preterminated to electrical contacts within a connector housing block.

Yet a further object of the present invention is to provide a commoning contact for electrically interconnecting a row of connector housing terminals, which components being economically produced, and readily utilized.

These and other objects, which will become apparent to one skilled in the art, are achieved by a preferred embodiment which is described in detail below, and which is illustrated in the accompanying drawings.

BRIEF DESCRIPTION OF THE ACCOMPANYING DRAWINGS

FIG. 1 is an exploded perspective view of the subject invention, illustrating a connector housing having the commoning component exploded therefrom, and a cover plate configured pursuant to the present invention.

FIG. 2-A is a side section view through the connector housing illustrated in FIG. 1, with the commoning element loaded into the connector housing block, and the cover plate advancing theretoward.

FIG. 2-B is a side section view through the connector housing of FIG. 1, in the fully assembled condition.

DETAILED DESCRIPTION OF THE PREFERRED EMBODIMENT

Figure 2B:
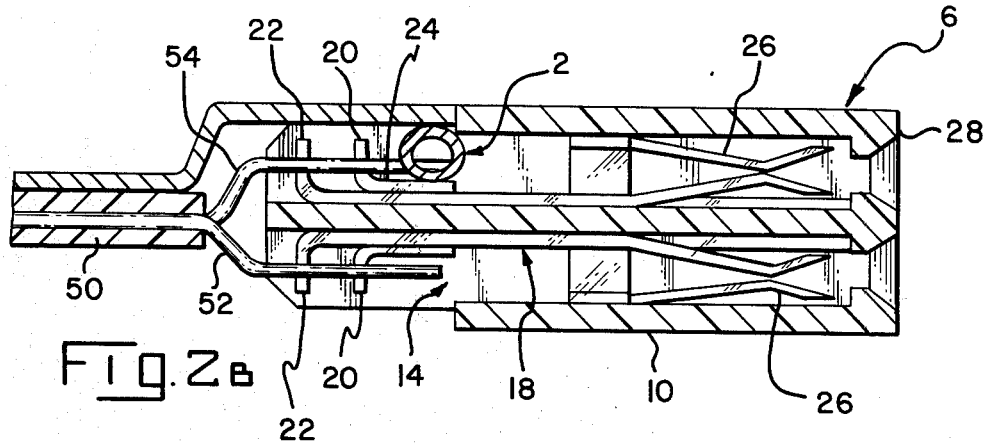

Referring first to FIGS. 1 and 2-A, the preferred embodiment of the present invention is shown to comprise an elongate helical spring 2, having a plurality of sequential coils 4 lengthwise therealong. A connector housing 6 is shown, comprising a top surface 8 and a bottom surface 10, into which a row of upper cavities 12 and a row of lower cavities 14, respectively, are formed. A plurality of upper contact members 16 are seated within respective upper cavities 12, and likewise a plurality of lower contact members 18 are seated within the lower cavities 14.

Each of the contact members 16, 18, are structured to include a forward insulation displacement slot 20, and a rearward insulation displacement slot 22, with the forward insulation displacement slot 20 having a horizontal base portion 24. Each contact member is further adapted to provide a female receptacle portion 26 positioned proximate a forward mating end 28 of the connector.

Figure 3:
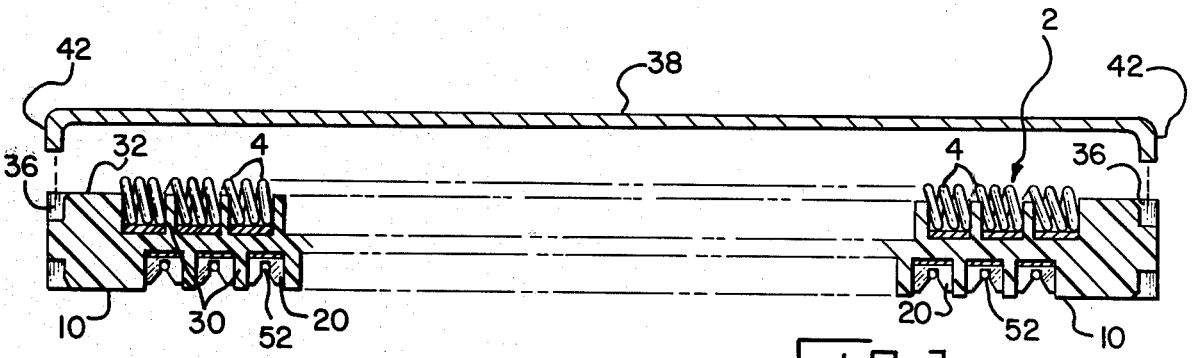
FIG. 3 is a transverse section view through the connector housing of FIG. 1, illustrating the commoning component loaded into the housing block, and the cover plate advancing theretoward.

As shown by FIGS. 1 and 3, adjacent cavities 12 are separated by an integral molded barrier 30, having an upper surface recessed slightly below a supporting surface 32 of the connector housing 6. The connector housing is provided with a side profile 34, including a pair of separated slots 36 formed therein.

Continuing, the cover element 38 illustrated in FIG. 1, constitutes a flat plate portion 40 having a pair of dependent tabs 42 formed at each end thereof, and a serpentine profiled cable strain relief portion 44 extending along a rearward longitudinal side thereof. Further provided within the flat plate portion 40, is an aperture 46, and a semi-circular slot 48 formed within one side of the portion 40.

As shown best by FIG. 2-A, the connector described above is intended to terminate a transmission cable 50, of the type comprising a plurality of signal conductors 52 and a plurality of ground conductors 54. The signal conductors and the ground conductors are interspaced along the width of the cable, as shown by FIG. 1.

With reference to FIGS. 1, 2-A and 3, assembly of the connector proceeds as follows. The signal conductors 52 and the ground conductors 54 of the cable 50, are directed to respective surfaces of the connector housing 6, and are terminated into the slots 22, 20 of respective terminal contacts seated therein. Accordingly, the upper contact members 16, seated within the row of upper cavities 12, terminate the ground conductors of the cable, and the lower contact members 18 seated within the lower cavities 14 terminate a row of the signal conductors of the cable.

The helical spring 2 is subsequently axially positioned in alignment with the row of upper cavities 12, and generally dropped into the cavities as shown by FIG. 2-A. There located, individual coils 4 of the helical spring 2 project into respective cavities 12, as shown by FIG. 3, and engage the base portion 24 of the upper contact members 16. Preferably, two or three adjacent coils 4 will project into each upper cavity 12, although by varying the coil density, or the cavity spacing, any number of coils can be designed to project into each cavity and contact each terminal as desired.

Figure 4:
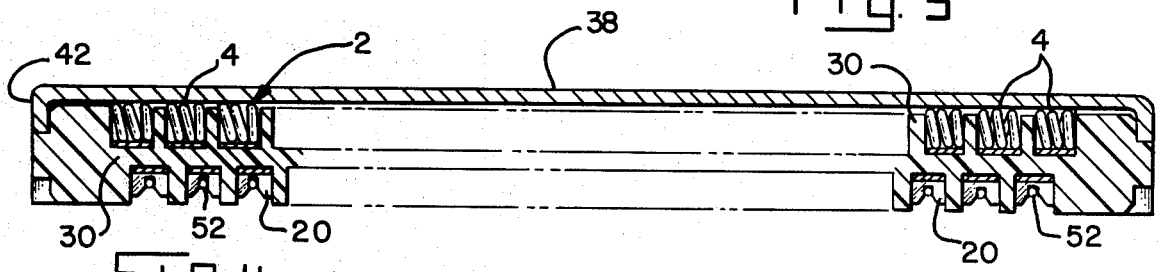
FIG. 4 is a transverse section view through the assembled connector illustrated in FIG. 1.
Figure 5:
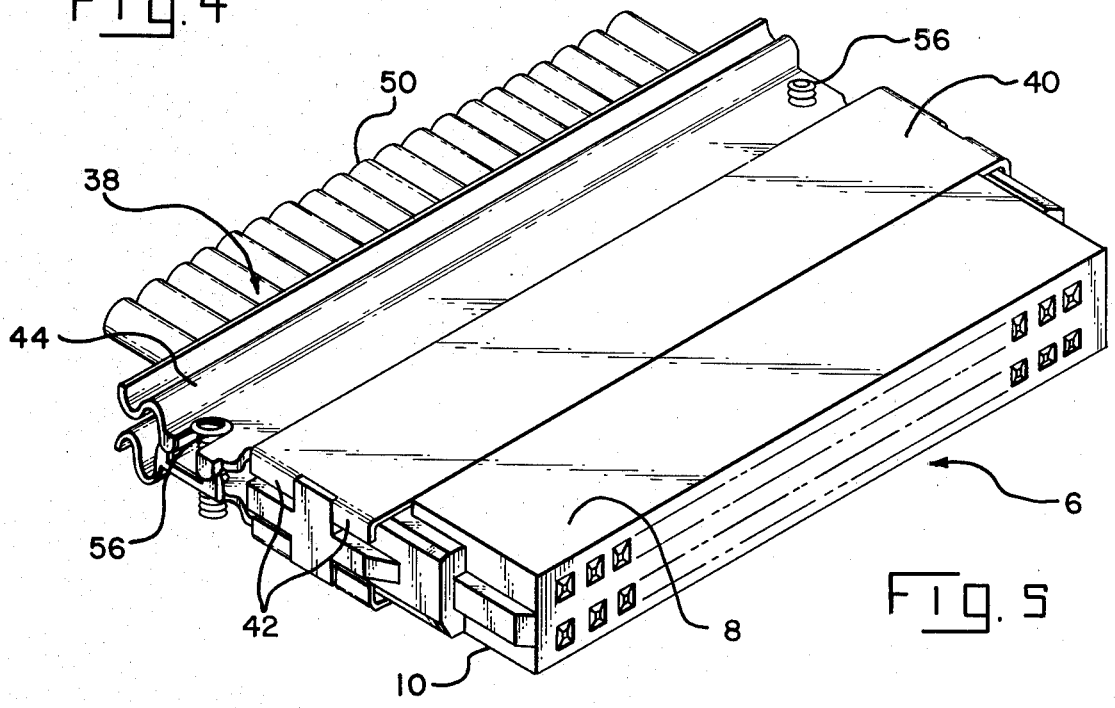
FIG. 5 is a perspective view of the assembled connector of FIG. 1, with strain relief portions of the cover plates attached to one another pursuant to the teachings of the present invention.

Thereafter, the cover component 38 is brought into a position indicated in FIG. 1, and positioned against the connector housing 6 such that the plate portion 40 of the cover component 38 is substantially coplanar with the top surface 8 of the connector housing, and the dependent tabs 42 project in alignment into the slots 36 of the side profile 34. This occurrence is illustrated in FIG. 4. While only one cover component 38 is shown in FIG. 1, an identical, configured cover component is affixed to the bottom side of the connector housing. The two cover plates are then secured together as illustrated in FIG. 5, by a pair of assembly screws 56, which respectively project through the aperture 46 and the semi-circular slot 48 of each cover component 38.

From FIGS. 3 and 4, it will be appreciated that as the cover component 38 is brought against the spring 2, the coils 4 of the helical spring 2 are compressed and influenced downwardly against the base portions 24 of corresponding contact members 16. This downward compression force establishes and preserves positive engagement between the helical spring 2 and each of the upper contact members 16, whereby each ground conductor 54 of the cable 50 is thereby commoned.

The above description of the preferred embodiment may be subject to many variations, without departing from the scope and spirit of the present invention. While only the preferred embodiment has been described, other embodiments which will be apparent to those skilled in the art, and which utilize the teachings herein set forth, are intended to be within the scope and spirit of the present disclosure.

What is claimed is:

1. In an electrical connector of the type comprising a housing block having a row of cavities within one surface thereof, contact members seated in respective ones of said row of cavities, and commoning means for electrically connecting each said contact member, the improvement comprising:

each of said contact members comprising support portion means positioned within a respective cavity of said row of cavities, said cavities being open to said one surface;

said commoning means comprising elongate radially compressible spring means positioned transversely above said support portion means of said contact members; and means provided by said housing block being movable towards said one surface for covering said row of cavities along said one surface, radially compressing said spring means through said one surface into intimate engagement against said support means of said contact members and to maintain said spring means in electrical contact with said contact members whereby electrical contact is established between said contact members.

2. A connector as set forth in claim 1, wherein said spring means comprises a helical spring member, said contact members support portion means being contacted by selective coils of said helical spring member.

3. A connector as set forth in claim 1, wherein said means for compressing said spring means comprises a cover plate having means for attaching to said housing block.

4. In an electrical connector of the type comprising a housing block having a row of contact members seated within one surface thereof, and commoning means for electrically connecting each said contact member, the improvement comprising:

each of said contact members comprising support portion means positioned within a cavity of said housing block which is open to said one surface;

said commoning means comprising an elongate helical spring member located transversely above said support portion means of said contact members;

cover plate means provided by said housing block and being movable towards said one surface for covering said support portion means along said one surface, radially compressing said helical spring member through said one surface into intimate engagement against said support portion means of said contact members to maintain said helical spring member in electrical contact with said contact members, whereby electrical contact is established between said contact members.

5. An electrical connector as set forth in claim 4, wherein said cover plate means includes rearwardly disposed means for providing strain relief to an electrical cable electrically connected to said contact members.

6. In an electrical connector of the type comprising a housing block having a row of cavities in one surface thereof, adjacent cavities being separated by integral barriers and each of said cavities receiving a contact member therein, and commoning means for electrically connecting each said contact member, the improvement comprising:

each said contact member comprising support portion means positioned within a respective one of said cavities, said support portion means being openly accessible from said one surface;

each of said cavity barriers having a top surface recessed slightly below said one surface, whereby a shallow channel is defined across said row of cavities;

said commoning means comprising an elongate helical spring member located within said channel and having coils projecting into respective cavities toward said support portion means of said contact members; and means for radially compressing said helical spring member against said support portion means of said contact members, whereby electrical contact is established between said contact members.

7. A connector as set forth in claim 6, wherein said means for compressing said helical spring comprises a cover plate having means for attachment to said housing block.

* * * * *